US011633640B2

(12) United States Patent
Lagree et al.

(10) Patent No.: US 11,633,640 B2
(45) **Date of Patent: *Apr. 25, 2023**

(54) EXERCISE MACHINE TENSION DEVICE SECURING SYSTEM

(71) Applicant: Lagree Technologies, Inc., Chatsworth, CA (US)

(72) Inventors: Sebastien Anthony Louis Lagree, Chatsworth, CA (US); Samuel D. Cox, Yuba City, CA (US); Todd G. Remund, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/992,146

(22) Filed: Nov. 22, 2022

(65) Prior Publication Data

US 2023/0078801 A1 Mar. 16, 2023

Related U.S. Application Data

(63) Continuation of application No. 17/227,625, filed on Apr. 12, 2021, now Pat. No. 11,511,148, which is a (Continued)

(51) Int. Cl.
*A63B 21/02* (2006.01)
*A63B 22/00* (2006.01)
(Continued)

(52) U.S. Cl.
CPC ..... *A63B 21/023* (2013.01); *A63B 21/00065* (2013.01); *A63B 21/028* (2013.01);
(Continued)

(58) Field of Classification Search
CPC ..... A63B 21/00065; A63B 21/023; A63B 21/028; A63B 21/0428; A63B 21/0552;
(Continued)

(56) References Cited

U.S. PATENT DOCUMENTS 131,886 A 10/1872 Little
339,638 A 4/1886 Goldie
(Continued)

FOREIGN PATENT DOCUMENTS

JP 106278 A 1/1998
KR 1020040097734 B1 11/2004
(Continued)

OTHER PUBLICATIONS http://www.brainproducts.com/productdetails.php?id=63&tab=1; LiveAmp Overview; Jun. 14, 2016.
(Continued)

*Primary Examiner* — Joshua Lee
(74) *Attorney, Agent, or Firm* — Neustel Law Offices

(57) ABSTRACT

An exercise machine tension device securing system for safely and efficiently securing selectable biasing members to an exercise machine. The exercise machine tension device securing system generally includes an exercise machine including a frame and a carriage movably positioned on the frame. A plurality of tension devices may be connected to the frame at one end; with the other end being removably connected to the carriage by a selection device. The selection device may include a plurality of slots for removably receiving one or more of the tension devices to secure the tension devices selectively to the carriage. A securing member movably connected to the selection device includes projections adapted to selectively enclose the slots so as to secure the tension devices within the slots of the selection device.

20 Claims, 11 Drawing Sheets

Related U.S. Application Data continuation of application No. 16/779,643, filed on Feb. 2, 2020, now Pat. No. 10,974,089, which is a continuation of application No. 16/008,193, filed on Jun. 14, 2018, now Pat. No. 10,549,140.

(60) Provisional application No. 62/519,580, filed on Jun. 14, 2017.

(51) Int. Cl.

| | |
|---|---|
| ***A63B 21/00*** | (2006.01) |
| ***A63B 21/055*** | (2006.01) |
| ***A63B 21/04*** | (2006.01) |
| *A63B 22/20* | (2006.01) |

(52) U.S. Cl.
CPC ..... *A63B 21/0428* (2013.01); *A63B 21/0552* (2013.01); *A63B 21/0557* (2013.01); *A63B 21/154* (2013.01); *A63B 22/0089* (2013.01); *A63B 22/203* (2013.01)

(58) Field of Classification Search
CPC .. A63B 21/154; A63B 22/0089; A63B 22/203
See application file for complete search history.

(56) References Cited

U.S. PATENT DOCUMENTS

| | | | |
|---|---|---|---|
| 1,621,477 | A | 3/1927 | Pilates |
| 3,770,267 | A | 11/1973 | McCarthy |
| 3,806,094 | A | 4/1974 | Harken |
| 4,013,068 | A | 3/1977 | Settle |
| 4,759,540 | A | 7/1988 | Yu |
| 4,798,378 | A | 1/1989 | Jones |
| 5,066,005 | A | 11/1991 | Luecke |
| 5,201,694 | A | 4/1993 | Zappel |
| 5,263,913 | A | 11/1993 | Boren |
| 5,295,935 | A | 3/1994 | Wang |
| 5,316,535 | A | 5/1994 | Bradbury |
| 5,365,934 | A | 11/1994 | Leon |
| D362,700 | S | 9/1995 | Breibart |
| D382,319 | S | 8/1997 | Gerschefske |
| 5,681,249 | A | 10/1997 | Endelman |
| 5,738,104 | A | 4/1998 | Lo |
| 5,812,978 | A | 9/1998 | Nolan |
| 5,885,197 | A | 3/1999 | Barton |
| 5,967,955 | A | 10/1999 | Westfall |
| 5,989,163 | A | 11/1999 | Rodgers, Jr. |
| 6,045,491 | A | 4/2000 | McNergney |
| 6,152,856 | A | 11/2000 | Studor |
| 6,179,753 | B1 | 1/2001 | Barker |
| 6,261,205 | B1 | 7/2001 | Elefson |
| 6,626,802 | B1 | 9/2003 | Rodgers, Jr. |
| 6,790,162 | B1 | 9/2004 | Ellis |
| 6,790,163 | B1 | 9/2004 | Van De Laarschot |
| 6,929,589 | B1 | 8/2005 | Bruggemann |
| 7,108,635 | B2 | 9/2006 | Howlett-Campanella |
| 7,163,500 | B2 | 1/2007 | Endelman |
| 7,192,387 | B2 | 3/2007 | Mendel |
| 7,448,986 | B1 | 11/2008 | Porth |
| 7,537,554 | B2 | 5/2009 | Zhuang |
| 7,803,095 | B1 | 9/2010 | Lagree |
| 7,871,359 | B2 | 1/2011 | Humble |
| 7,878,955 | B1 | 2/2011 | Ehrlich |
| 7,914,420 | B2 | 3/2011 | Daly |
| 7,931,570 | B2 | 4/2011 | Hoffman |
| 7,967,728 | B2 | 6/2011 | Zavadsky |
| 8,249,714 | B1 | 8/2012 | Hartman |
| 8,287,434 | B2 | 10/2012 | Zavadsky |
| 8,303,470 | B2 | 11/2012 | Stewart |
| 8,585,554 | B2 | 11/2013 | Shavit |
| 8,641,585 | B2 | 2/2014 | Lagree |
| 8,812,075 | B2 | 8/2014 | Nguyen |
| 8,852,062 | B2 | 10/2014 | Dorsay |
| 8,911,328 | B2 | 12/2014 | Alessandri |
| 9,011,291 | B2 | 4/2015 | Birrell |
| 9,022,909 | B2 | 5/2015 | Kermath |
| 9,199,123 | B2 | 12/2015 | Solow |
| 9,283,422 | B2 | 3/2016 | Lagree |
| 9,533,184 | B1 | 1/2017 | Lagree |
| 9,555,282 | B1 | 1/2017 | Lagree |
| 10,046,193 | B1 | 8/2018 | Aronson |
| 10,155,129 | B2 | 12/2018 | Lagree |
| 2001/0056011 | A1 | 12/2001 | Endelman |
| 2002/0025888 | A1 | 2/2002 | Germanton |
| 2002/0025891 | A1 | 2/2002 | Colosky, Jr. |
| 2002/0082146 | A1 | 6/2002 | Stearns |
| 2002/0137607 | A1 | 9/2002 | Endelman |
| 2003/0119635 | A1 | 6/2003 | Arbuckle |
| 2004/0043873 | A1 | 3/2004 | Wilkinson |
| 2005/0085351 | A1 | 4/2005 | Kissel |
| 2005/0130810 | A1 | 6/2005 | Sands |
| 2005/0164853 | A1 | 7/2005 | Naidus |
| 2005/0164856 | A1 | 7/2005 | Parmater |
| 2006/0046914 | A1 | 3/2006 | Endelman |
| 2006/0105889 | A1 | 5/2006 | Webb |
| 2006/0183606 | A1 | 8/2006 | Parmater |
| 2006/0199712 | A1 | 9/2006 | Barnard |
| 2007/0087921 | A1 | 4/2007 | Graham |
| 2007/0202992 | A1 | 8/2007 | Grasshoff |
| 2007/0224582 | A1 | 9/2007 | Hayashino |
| 2007/0270293 | A1 | 11/2007 | Zhuang |
| 2008/0051256 | A1 | 2/2008 | Ashby |
| 2008/0058174 | A1 | 3/2008 | Barnard |
| 2008/0070765 | A1 | 3/2008 | Brown |
| 2008/0139975 | A1 | 6/2008 | Einav |
| 2008/0242519 | A1 | 10/2008 | Parmater |
| 2008/0248935 | A1 | 10/2008 | Solow |
| 2008/0254952 | A1 | 10/2008 | Webb |
| 2009/0005698 | A1 | 1/2009 | Lin |
| 2009/0023561 | A1 | 1/2009 | Ross |
| 2009/0291805 | A1 | 11/2009 | Blum |
| 2009/0312152 | A1 | 12/2009 | Kord |
| 2010/0016131 | A1 | 1/2010 | Hoffman |
| 2010/0125026 | A1 | 5/2010 | Zavadsky |
| 2010/0144499 | A1 | 6/2010 | Graham |
| 2010/0227748 | A1 | 9/2010 | Campanaro |
| 2010/0267524 | A1 | 10/2010 | Stewart |
| 2011/0009249 | A1 | 1/2011 | Campanaro |
| 2011/0018233 | A1 | 1/2011 | Senner |
| 2011/0039665 | A1 | 2/2011 | Dibble |
| 2011/0077127 | A1 | 3/2011 | Ishii |
| 2011/0143898 | A1 | 6/2011 | Trees |
| 2011/0152045 | A1 | 6/2011 | Horne |
| 2011/0166002 | A1 | 7/2011 | Savsek |
| 2011/0172069 | A1 | 7/2011 | Gerschefske |
| 2011/0184559 | A1 | 7/2011 | Benabid |
| 2012/0015334 | A1 | 1/2012 | Hamilton |
| 2012/0088634 | A1 | 4/2012 | Heidecke |
| 2012/0143020 | A1 | 6/2012 | Bordoley |
| 2012/0190505 | A1 | 7/2012 | Shavit |
| 2012/0202656 | A1 | 8/2012 | Dorsay |
| 2012/0228385 | A1 | 9/2012 | DeLuca |
| 2012/0295771 | A1 | 11/2012 | Lagree |
| 2013/0017935 | A1 | 1/2013 | Endelman |
| 2013/0072353 | A1 | 3/2013 | Alessandri |
| 2013/0150216 | A1 | 6/2013 | Bell |
| 2013/0196835 | A1 | 8/2013 | Solow |
| 2013/0210578 | A1 | 8/2013 | Birrell |
| 2013/0210593 | A1 | 8/2013 | McBride |
| 2013/0289889 | A1 | 10/2013 | Yuen |
| 2014/0011645 | A1 | 1/2014 | Johnson |
| 2014/0066257 | A1 | 3/2014 | Shavit |
| 2014/0087922 | A1 | 3/2014 | Bayerlein |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2014/0148715 | A1 | 5/2014 | Alexander |
| 2014/0213415 | A1 | 7/2014 | Parker |
| 2015/0012111 | A1 | 1/2015 | Contreras-Vidal |
| 2015/0024914 | A1 | 1/2015 | Lagree |
| 2015/0057127 | A1 | 2/2015 | Lagree |

(56) References Cited

U.S. PATENT DOCUMENTS

| | | | |
|---|---|---|---|
| 2015/0065318 | A1 | 3/2015 | Lagree |
| 2015/0072841 | A1 | 3/2015 | Lagree |
| 2015/0105223 | A1 | 4/2015 | Bissu |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0329011 | A1 | 11/2015 | Kawai |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0364059 | A1 | 12/2015 | Marks |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2017/0304673 | A1 | 10/2017 | Lagree |
| 2017/0326406 | A1 | 11/2017 | Lagree |
| 2017/0340947 | A1 | 11/2017 | Lagree |
| 2017/0354840 | A1 | 12/2017 | Lagree |
| 2018/0015319 | A1 | 1/2018 | Lagree |
| 2018/0021621 | A1 | 1/2018 | Lagree |
| 2018/0021655 | A1 | 1/2018 | Lagree |
| 2018/0036583 | A1 | 2/2018 | Lagree |
| 2018/0056109 | A1 | 3/2018 | Lagree |
| 2018/0056133 | A1 | 3/2018 | Lagree |
| 2018/0111020 | A1 | 4/2018 | Lagree |
| 2018/0111033 | A1 | 4/2018 | Lagree |
| 2018/0117392 | A1 | 5/2018 | Lagree |
| 2018/0133532 | A1 | 5/2018 | Lagree |
| 2018/0133533 | A1 | 5/2018 | Lagree |
| 2018/0133534 | A1 | 5/2018 | Lagree |
| 2018/0133542 | A1 | 5/2018 | Lagree |
| 2020/0222741 | A1 | 7/2020 | Aronson |

FOREIGN PATENT DOCUMENTS

| | | | |
|---|---|---|---|
| WO | 2004096376 | A1 | 11/2004 |
| WO | 2014084742 | A1 | 6/2014 |

OTHER PUBLICATIONS http://www.cognionics.com/index.php/products/hd-eeg-systems/72-channel-system; Cognionics HD-72 Overview; Jun. 14, 2016.

http://www.cognionics.com/index.php/products/hd-eeg-systems/quick-20-dry-headset; Cognionics Quick-20 Dry EEG Headset; Jun. 14, 2016.

http://www.cognionics.com/index.php/products/mini-systems/multi-position-dry-headband; Cognionics Multi-Position Dry EEG Headband; Jun. 14, 2016.

http://www.cognionics.com/index.php/products/mini-systems/dry-eeg-headband; Cognionics Dry EEG Headband; Jun. 14, 2016.

http://www.cognionics.com/index.php/products/hd-eeg-systems/mobile-eeg-cap; Cognionics Mobile-72 Wireless EEG System; Jun. 14, 2016.

PCT International Search and Opinion from International Searching Authority for PCT/US2017/041638; dated Sep. 28, 2017.

PCT Preliminary Report on Patentability from International Searching Authority for PCT/US2016/022888; dated Sep. 28, 2017.

PCT International Search and Opinion from International Searching Authority for PCT/US2016/022888; dated Jul. 25, 2016.

http://tera.lunar-europe.com; TERA Fitness Mat; Lunar Europe; Jun. 8, 2014.

http://www.puzzlebox.io/brainstorms/; Puzzlebox Brainstorms Website Article; Jun. 13, 2016.

https://www.youtube.com/watch?v=xj2xuGsB3yo; Screenshot of YouTube Video "Iphone free App (Dec. 16, 2010) Finger Balance"; Tuuske; Dec. 16, 2010.

PCT International Search Report and Written Opinion for PCT/US2015/047746 from the Korean Intellectual Property Office; dated Nov. 19, 2015.

PCT International Search Report and Written Opinion for PCT/US2015/047763 from the Korean Intellectual Property Office; dated Nov. 19, 2015.

EXERCISE MACHINE TENSION DEVICE SECURING SYSTEM

CROSS REFERENCE TO RELATED APPLICATIONS

The present application is a continuation of U.S. application Ser. No. 17/227,625 filed Apr. 12, 2021 which issues as U.S. Pat. No. 11,511,148 on Nov. 29, 2022, which is a continuation of U.S. Application Ser. No. 16/779,643 filed on Feb. 2, 2020 now issued as U.S. Pat. No. 10,974,089, which is a continuation of U.S. application Ser. No. 16/008,193 filed on Jun. 14, 2018 now issued as U.S. Pat. No. 10,549,140, which claims priority to U.S. Provisional Application No. 62/519,580 filed Jun. 14, 2017. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine tension device securing system for safely and efficiently securing selectable biasing members to an exercise machine.

Related Art

Any discussion of the related art throughout the specification should in no way be considered as an admission that such related art is widely known or forms part of common general knowledge in the field.

Having been a core training method for more than a century, resistance based fitness training is well known to those skilled in the art. In the simplest form, resistance training requires nothing more than exerting a force against a free weight, for instance, performing an exercise known as a curl by raising a hand-held dumbbell from a straight arm-down position along the side of the body, to a raised position by simply bending the elbow.

More recently, spring biasing members have replaced free weights, allowing for larger machines to be manufactured with hundreds of pounds of weight equivalent resistance force, but at a fraction of the total weight of the equivalent free weights. Merely as one example, six springs rated at fifty pounds of peak resistance, or three hundred pounds, may weigh only forty pounds, while the free weight equivalent would weigh the full three hundred pounds.

Therefore, the advantages of spring-based resistance machines include lower weight, lower shipping cost, and uniquely, the ability to more easily direct the resistance force in any direction by use of pulleys and cables, compared to the limitation of free weights which exert only a gravitational force downward.

A prime example of a spring biased training apparatus is a substantially horizontal machine with a horizontally rolling carriage that is resistance biased toward one end of the machine by use of one or more springs. An exerciser sitting on the carriage may pull the carriage along a track with a force that exceeds the force of the springs connected between the carriage and the opposed end of the exercise machine.

An exerciser may further attach or detach one or more springs between the stationary end of the machine and the rolling carriage to increase or decrease the resistance force desired for any particular exercise.

Springs under tension, while creating resistance, may also pose a safety hazard to the exerciser. In use, it is not uncommon for springs to experience catastrophic failure while under tension, causing the two ends of the broken spring to retract with uncontrolled speed, force and direction. In other more common instances, a user may mistakenly disconnect a springs from the carriage while the spring is under tension, causing the unattached spring to retract unexpectedly and with considerable force that could cause injury to the exerciser.

Therefore, those skilled in the art will appreciate the safety value of a of a device that would help ensure that user selectable springs would be retained in their user-selectable positions through and exercise, and more importantly, prevent the accidental disengagement of any spring while it is under tension.

SUMMARY

An example embodiment is directed to an exercise machine tension device securing system. The exercise machine tension device securing system includes an exercise machine including a frame and a carriage movably positioned on the frame. A plurality of tension devices may be connected to the frame at one end; with the other end being removably connected to the carriage by a selection device. The selection device may include a plurality of slots for removably receiving one or more of the tension devices to secure the tension devices selectively to the carriage. A securing member movably connected to the selection device includes projections adapted to selectively enclose the slots so as to secure the tension devices within the slots of the selection device.

There has thus been outlined, rather broadly, some of the embodiments of the exercise machine tension device securing system in order that the detailed description thereof may be better understood, and in order that the present contribution to the art may be better appreciated. There are additional embodiments of the exercise machine tension device securing system that will be described hereinafter and that will form the subject matter of the claims appended hereto. In this respect, before explaining at least one embodiment of the exercise machine tension device securing system in detail, it is to be understood that the exercise machine tension device securing system is not limited in its application to the details of construction or to the arrangements of the components set forth in the following description or illustrated in the drawings. The exercise machine tension device securing system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
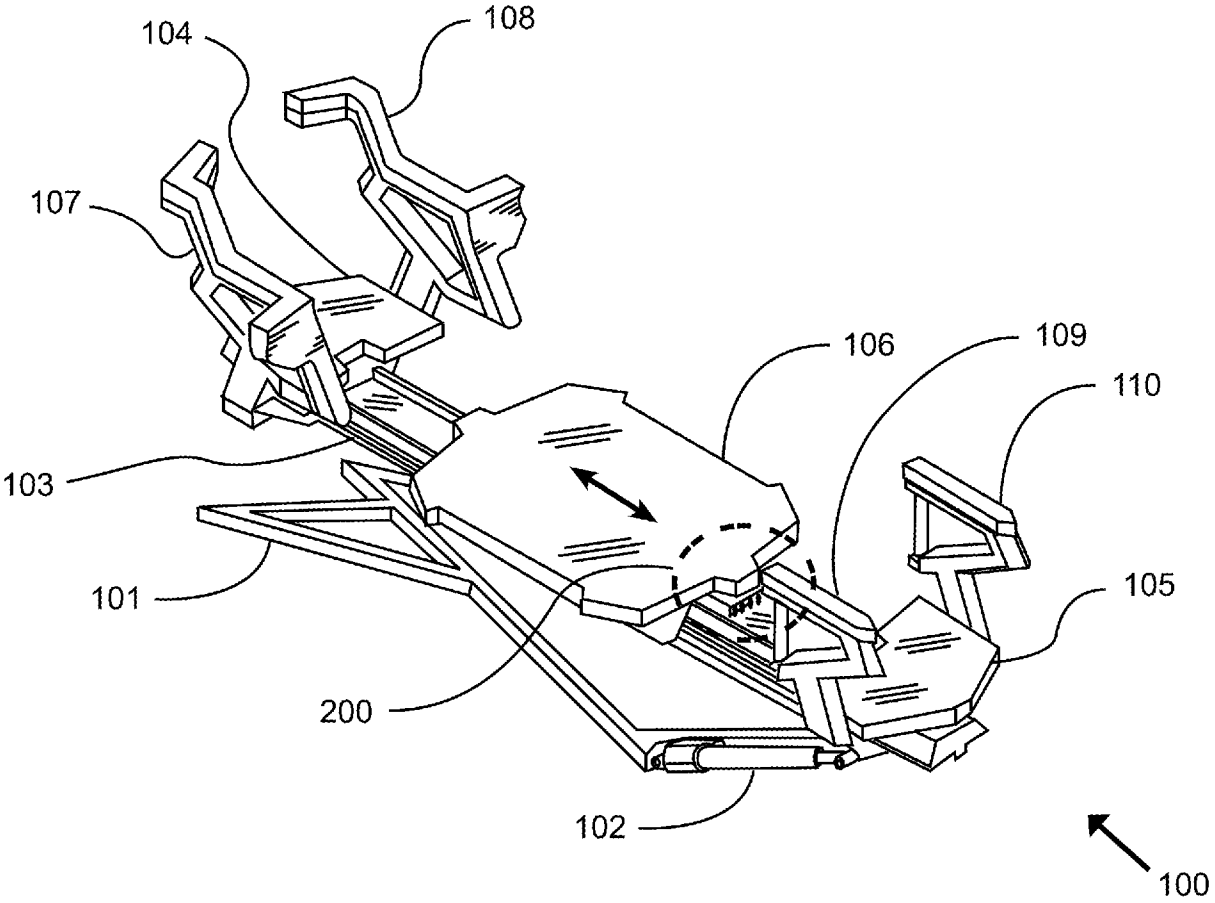
FIG. 1 is an exemplary diagram showing an isometric view of a spring resistance exercise machine of an exercise machine tension device securing system in accordance with an example embodiment.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The phrases "biasing member" and "tension device" are used herein to describe one or more connected components providing a means of inducing a resistance force of an exercise machine against which an exerciser must apply a greater muscle force to overcome. A "biasing member" or "tension device" may therefore be an extension spring, elastic band, a weight, or any of a spring, elastic band or weight connected to a cable or linkage that redirects a force of one of more resistance-inducing components to a movable component used by an exerciser for performing an exercise against the resistance.

An exemplary embodiment of an exercise machine tension device securing system may include an exercise machine 100 comprising a frame 101 such as a base structure, wherein the frame 101 includes a first end and a second end. A carriage 106 may be movably positioned upon the frame 101; with the carriage 106 being adapted to be movable in a reciprocating manner along at least a portion of an axis extending between the first and the second end of the frame 101. A tension device 112 such as a resistance biasing member may be connected to the frame 101.

A selection device 202 may be connected to the carriage 106; with the selection device 202 being comprised of a slot 211, wherein the slot 211 is adapted to selectively and removably receive a distal end of the tension device 112 such that the tension device 112 applies a force against the carriage 106. A securing member 203 may be movably connected to the selection device 202; with the securing member 203 being adapted to selectively enclose the slot 211 when the tension device 112 is positioned within the slot 211 so as to secure the tension device 112 within the slot 211. The securing member 203 may be adjustable between a first position in which the securing member 203 encloses the slot 211 and a second position in which the securing member 203 does not enclose the slot 211. The selection device 202 may comprise a projection 210 adapted to selectively enclose the slot 211. The slot 211 may be vertically oriented and the projection 210 may be horizontally oriented so as to selectively extend across and enclose the slot 211.

A reserve member 204 may be connected to the frame 101; with the reserve member 204 comprising a reserve slot 219 for receiving the tension device when the tension device 112 is not connected to the carriage 106. The securing member 203 may be adapted to slide with respect to the selection device 202. A selector biasing member 214 may be connected between the selection device 202 and the securing member 203; with the selector biasing member 214 being adapted to bias the securing member 203 toward the first position. A first magnet 206 may be connected to the selection device 202 and a second magnet may be connected to the securing member 203 such that the first magnet 206 is adapted to magnetically engage with the second magnet 207 when the securing member 203 is in the second position.

In another exemplary embodiment, an actuator 215 may be connected between the selection device 202 and the second member 203; with the actuator 215 being adapted to move the securing member 203 between the first position and the second position. A proximity target 217 may be connected to the selection device 202 and a proximity switch 216 may be connected to the securing member 203; with the actuator 215 being adapted to move the securing member from the first position to the second position when the proximity target 217 is near the proximity switch 216.

Yet another exemplary embodiment of the exercise machine tension device securing system may comprise an exercise machine 100 comprising a frame 101 such as a base structure, wherein the frame 101 includes a first end and a second end. A carriage 106 may be movably positioned upon the frame 101; with the carriage 106 being adapted to be movable in a reciprocating manner along at least a portion of an axis extending between the first and the second end of the frame 101. A plurality of tension devices 112 such as resistance biasing members may be connected to the frame 101.

A selection device 202 may be connected to the carriage 106; with the selection device 202 being comprised of a plurality of slots 211, wherein each of the plurality of slots 211 is adapted to selectively and removably receive a distal end of one of the plurality of tension devices 112 such that the tension devices received by the plurality of slots 211 each apply a force against the carriage 106. A securing member 203 may be movably connected to the selection device 202; with the securing member 203 being adapted to selectively enclose each of the plurality of slots 211. The securing member 203 may be adjustable between a first position in which the securing member 203 encloses the plurality of slots 211 and a second position in which the securing member 203 does not enclose the plurality of slots 211. The securing member 203 may comprise a plurality of projections 210, wherein each of the plurality of projections 210 is adapted to selectively enclose one of the plurality of slots 211.

A reserve member 204 may be connected to the frame 101; the reserve member 204 comprising a plurality of reserve slots 219 for receiving any of the plurality of tension devices 112 which are not connected to the carriage 106. The slots 211 of the selection device 202 may be vertically-aligned with the reserve slots 219 of the reserve member 204 when the carriage 106 is in a resting positon on the frame 101.

FIG. 1 is an exemplary diagram showing an isometric view of an exemplary embodiment of a spring resistance exercise machine 100. It should be appreciated that various other types of exercise machines 100 may be utilized in connection with the methods and systems described herein, and thus the exemplary description that follows should not be construed as limiting with respect to the type of spring resistance exercise machine 100 utilized.

In the exemplary embodiment shown in the figures, a monorail center beam 103 is supported by a machine base structure such as a frame 101, a universal joint (not shown because it is obscured by the center beam), and a pair of position actuators 102. The exercise platforms comprise a front platform 104, a back platform 105, and a sliding carriage 106. Further, the machine provides for a front right handle 108, a front left handle 107, a back right handle 110 and a back left handle 109.

A resistance force may be applied to the sliding carriage 106 by means of one or more tension devices 112 such as resistance biasing members positioned within the internal longitudinal cavity of the monorail center beam 103. In practice, an exerciser may select one or more tension devices 112 to establish the preferred resistance force to be exerted against the sliding carriage 106 by attaching or detaching one or more tension devices 112 at the resistance selection assembly 200 which will be described in more detail.

Figure 2:
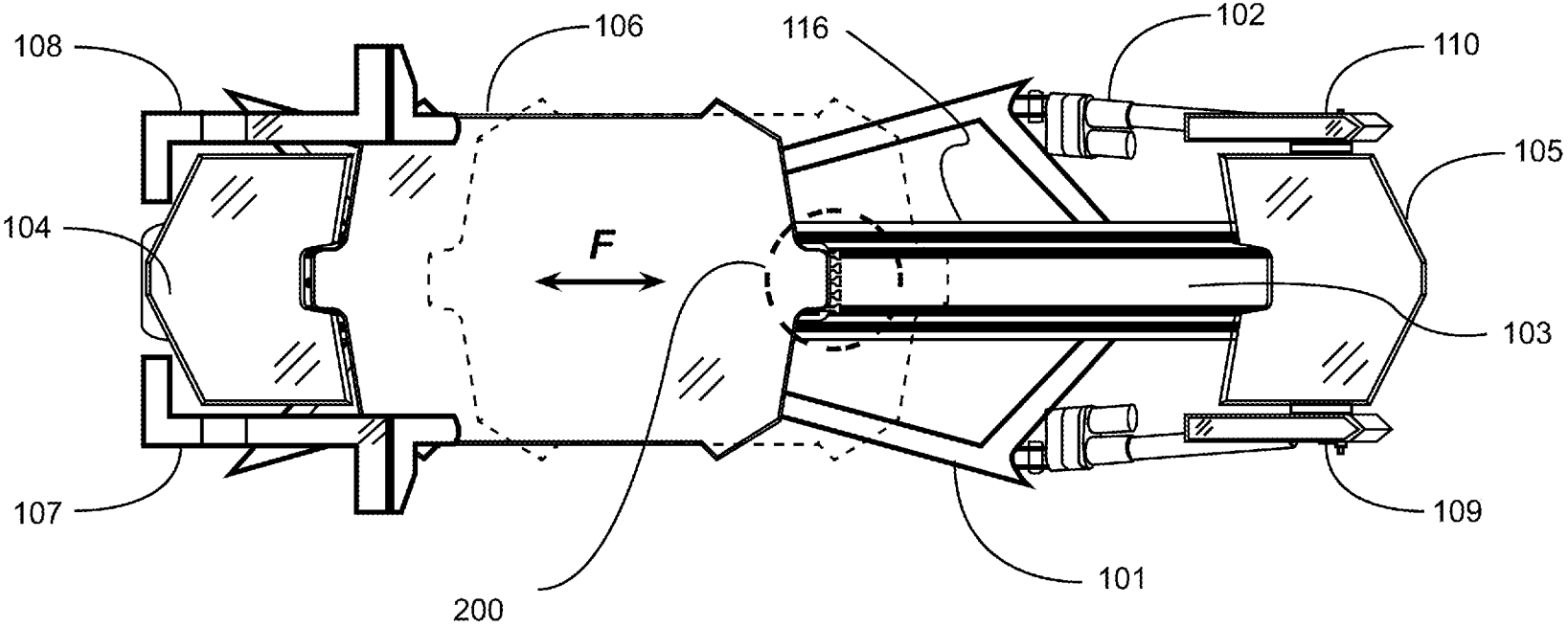
FIG. 2 is an exemplary diagram showing a top view of a spring resistance exercise machine of an exercise machine tension device securing system in accordance with an example embodiment.

FIG. 2 is an exemplary diagram showing a top view of an exemplary embodiment of a spring resistance exercise machine 100. A monorail center beam 103 may be supported by a frame 101, a universal joint (not shown), and a pair of position actuators 102. The exercise platforms may comprise a front platform 104, a back platform 105, and a sliding carriage 106. Further, the machine 100 may provide for a front right handle 108, a front left handle 107, a back right handle 110 and a back left handle 109.

The sliding carriage 106 may slide or otherwise move along the longitudinal axis of the center beam 103 on wheels or the like adapted to engage a pair of parallel carriage rails 116 that run substantially the length of the center monorail beam 103. A dashed line in FIG. 2 indicates one possible position of the sliding carriage 106 to illustrate the direction of carriage 106 movement.

An exemplary resistance selection assembly 200 is shown located within the dashed circle of FIGS. 1-4 as a location point of reference. It should be appreciated that the resistance selection assembly 200 described in more detail below is merely an exemplary embodiment. One of ordinary skill in the art will appreciate that a wide range of types of resistance selection assemblies 200 could benefit from the methods and systems described herein. Thus, the scope of the present invention should not be construed as limited to any particular type of resistance selection assembly 200, including the exemplary embodiment described herein.

Figure 3:
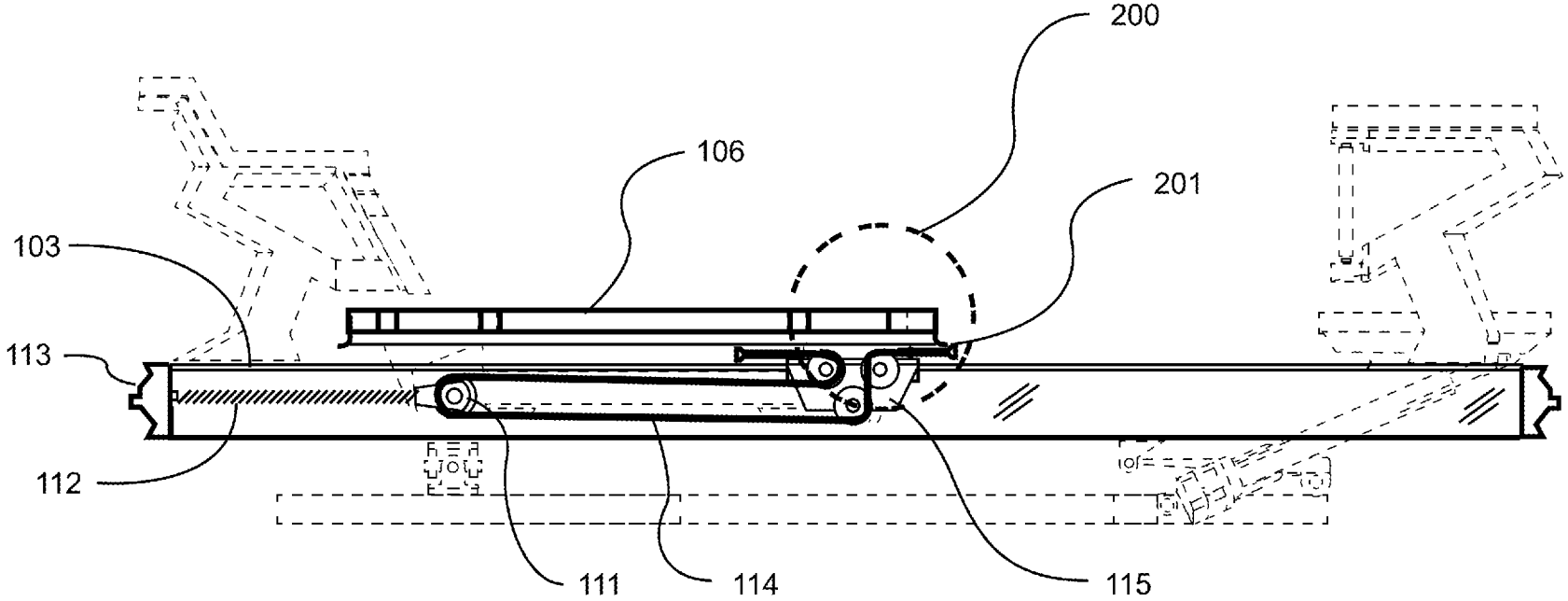
FIG. 3 is an exemplary diagram showing a side view section of a spring resistance exercise machine of an exercise machine tension device securing system in accordance with an example embodiment.

FIG. 3 is an exemplary diagram showing a side view section of an exemplary embodiment of a spring resistance exercise machine 100. It should be noted that the front and back handles 107, 108, 109, 110, the actuators 102, the machine base structure 101 and the universal joint are shown only in a dashed outline for reference in FIG. 3.

Continuing to reference FIG. 3, a monorail center beam 103 is shown in a sectional view with the near side being removed to reveal the internal resistance system therein. Monorail beam end caps 113 may be used to close the opposed ends of the tubular structure of the monorail center beam 103. A sliding carriage 106 is shown in the starting position, which is the point at which there is minimum force applied to the sliding carriage 106 by at least one tension device 112. This is the recommended safest position at which tension devices 112 may be engaged or disengaged with the sliding carriage 106.

As shown in FIG. 3, a pulley assembly 115 may be positioned approximately at the midpoint of the length of the monorail center beam 103, with a lower portion of the assembly 115 projecting into the interior cavity of the monorail beam 103, and an upper portion projecting above the top surface of the center beam 103. A fixed length cable is shown with each of the opposed ends terminated with an engagement knob 201; the engagement knobs 201 being accessible by an exerciser positioned upon the sliding carriage 106. The pulley assembly 115, together with the fixed length cable 114 and engagement knobs 201, substantially comprise an exemplary embodiment of a resistance selection assembly 200.

Each fixed length cable 114 may pass through a direction-reversing pulley 111; the pulley 111 being affixed to the proximate end of one resistance biasing member 112. The distal end of the tension devices 112 may be affixed to a termination member (not shown), but which is fixed at a position at substantially the distal end of the monorail center beam 103.

In practice, one or more tension devices 112 may be manually transferred from a disengaged position to an engaged position, such as by engagement knobs 201. Tension devices 112 and engagement knobs 201 in the disengaged position are not connected to the sliding carriage 106. Tension devices 112 and engagement knobs 201 in the engaged position are connected to the selection device 202 of the sliding carriage 106. The selection device 202 may be integral to the sliding carriage 106. The selection device 202 may comprise a knob engagement yoke such as shown in the figures.

The selection device 202 will be more fully described later, but those skilled in the art will immediately appreciate that when one or more tension devices 112 may be transferred from a disengaged position to an engaged position within the carriage-mounted selection device 202, the movement of the sliding carriage 106 along the length of the monorail center beam 103 will be transferred to the tension device 112 by the fixed length cable 114 passing through the pulley assembly 115; thereby transferring the resistance force of the tension device 112 to the sliding carriage 106.

Figure 4:
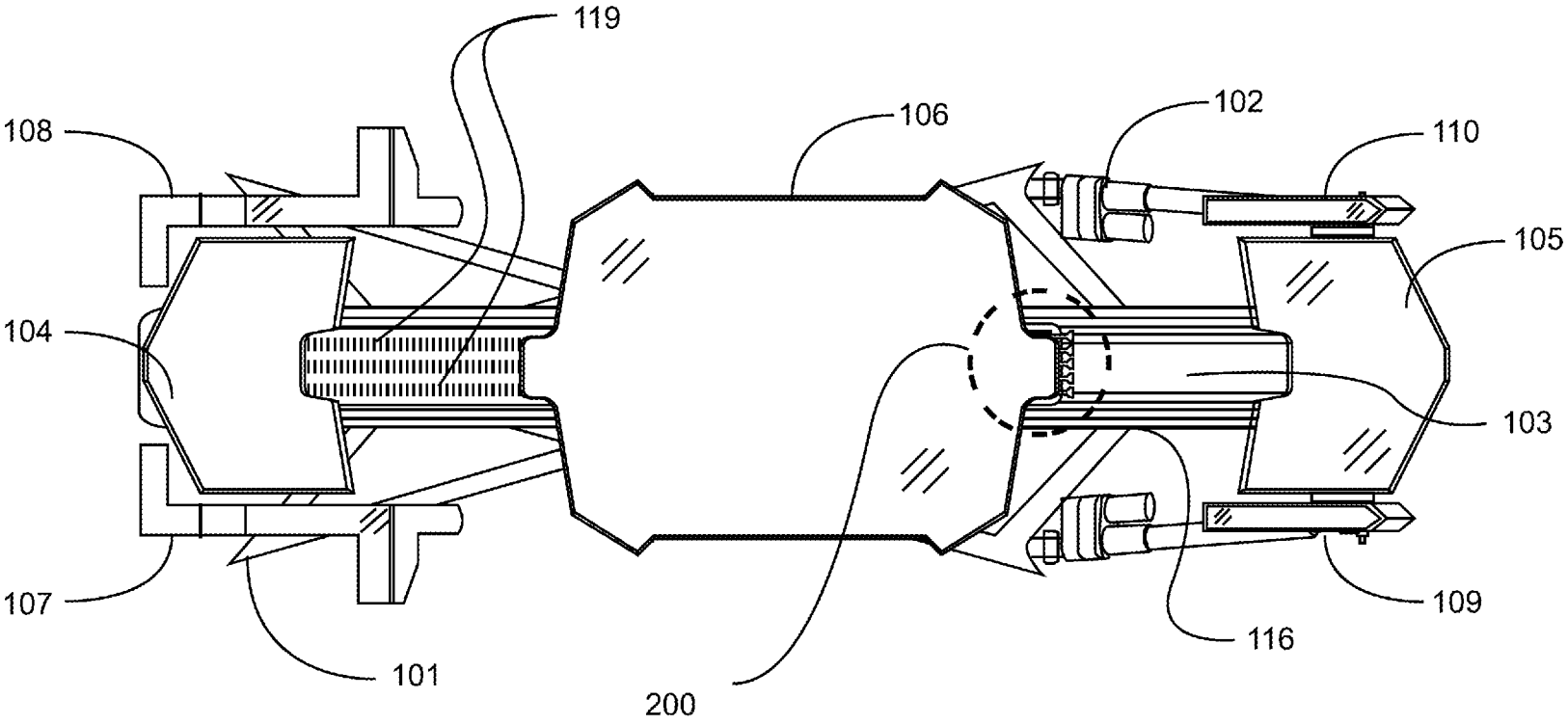
FIG. 4 is a top view of a variation of the exemplary embodiment of a spring exercise resistance machine of FIG. 2.

FIG. 4 is a top view of a variation of an exemplary embodiment of a spring exercise resistance machine 100. More specifically, a monorail center beam 103 as previously described is shown at one end proximate to a front platform 104 with a top cover having been removed to reveal a plurality of spring biasing members 119. In the variation, the biasing members 119 are removably connected at their distal ends to a resistance selection assembly 200 of the sliding carriage 106.

As an alternative to the biasing members 119 connected by a pulley 111 to a pull cable as previously described FIG. 3, those skilled in the art will appreciate that traditional Pilates-type of exercise machines 100 may comprise a plurality of exposed springs 119 affixed to one end of the machine 100, the opposed ends of the springs 119 being removably connected directly to the sliding carriage 106 as a means to exert a variable exercise resistance force on the sliding carriage 106. The traditional attachment methods of springs 119 to carriage 106 as just described creates a potential safety hazard; for instance, springs 119 that become accidentally detached from the carriage 106 while they are extended under force can be unexpectedly and violently retracted; with the flailing end of the spring 119 causing injury to exercisers.

Therefore, the present invention, specifically the resistance selection assembly 200 may be used to prevent accidental disengagement of springs 110 from the carriage 106 until and unless the carriage 106 is positioned proximate to the end platform 104; a position at which the spring 119 tension is minimal, or zero.

Figure 5:
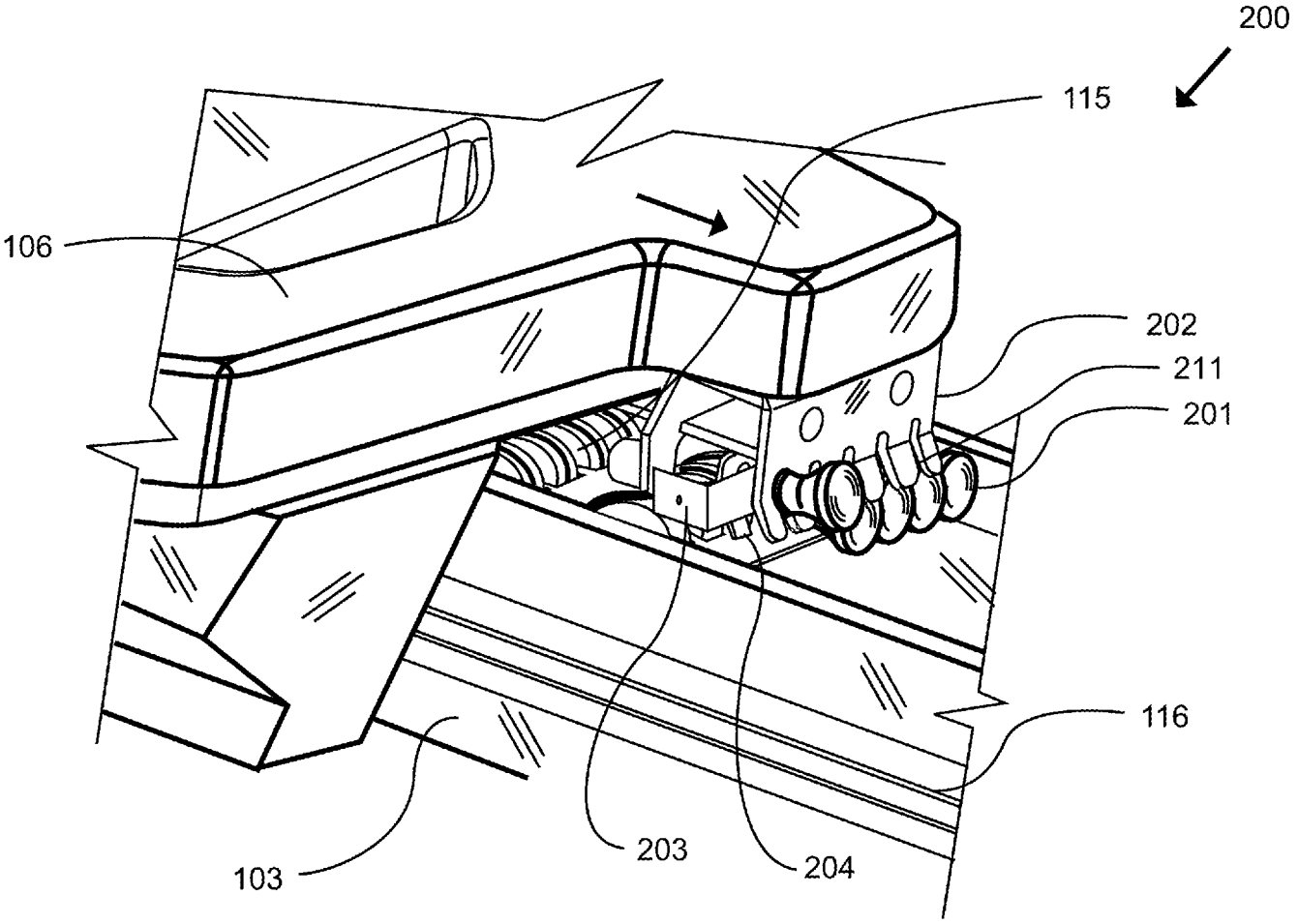
FIG. 5 is an exemplary diagram showing a close up isometric view of a resistance selection assembly of an exercise machine tension device securing system in accordance with an example embodiment.

FIG. 5 is an exemplary diagram showing a close-up isometric view of an exemplary embodiment of a resistance selection assembly 200. As just described, a selection device 202 may be affixed to the underside of at least one end of a sliding carriage 106. The sliding carriage 106 may ride on wheels or the like; the wheels or the like engaging a pair of parallel carriage rails 116 affixed to each transverse edge of the monorail center beam 103.

A plurality of engagement knobs 201 are shown in FIG. 5, with only the nearest one knob 201 retained in an upward angled position; the one knob 201 having been positioned into the selection device 202. The remaining knobs 201, each connected to their respective fixed length cables 114, and correspondingly to their respective tension devices 112, remain in a lowered, disengaged position, being secured in a reserve member 204 such as a resting yoke. Therefore, only the resistance created by the tension device 112 connected to the fixed length cable 114 terminated with the nearest knob 201 will be transferred to the sliding carriage 106 during an exercise. The upper portions of a plurality of pulleys 118 of a pulley assembly 115 can be seen positioned behind the resistance selection assembly.

A portion of a securing member 203 can be seen in FIG. 5 partially obscured by the selection device 202, the securing member 203 being slidable relative to the selection device 202. The securing member 203 may comprise a sliding safety latch as shown in the exemplary figures. The reserve member 204 and securing member 203 just described will be further detailed in the following specification.

Figure 6:
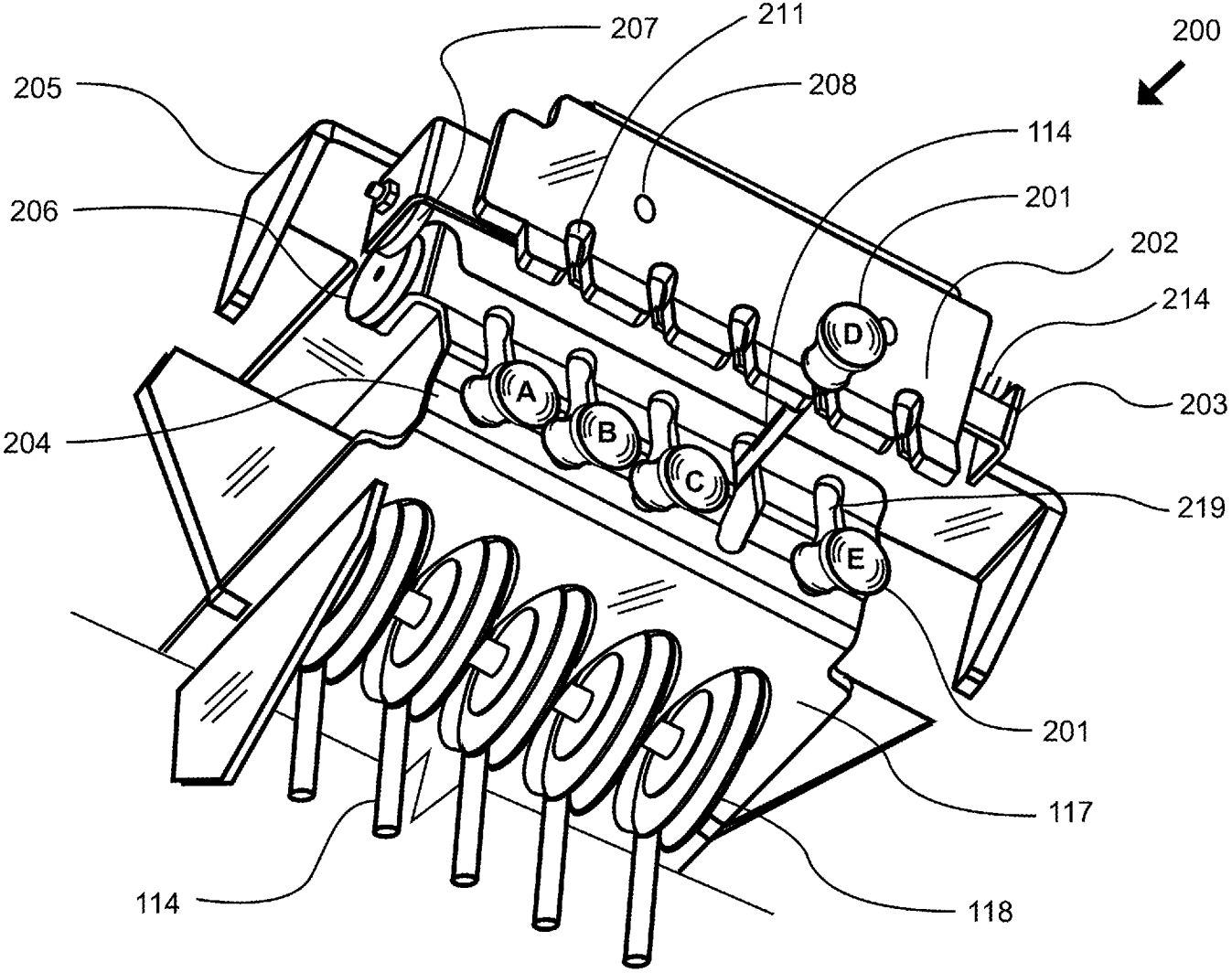
FIG. 6 is an exemplary diagram showing a bottom isometric view of a resistance selector assembly of an exercise machine tension device securing system in accordance with an example embodiment.

FIG. 6 is an exemplary diagram showing a bottom isometric view of an exemplary embodiment of a resistance selector assembly 200. More specifically, a portion of the pulley assembly 117 structure is shown, the pulley assembly 117 being affixed to the monorail center beam 103. A plurality of fixed length cables 114 are shown threaded around a portion of their respective idler pulleys 118; the proximate ends of the cables 114 each being terminated with an engagement knob 201.

Merely for reference purposes and to ensure clarity of the description, each engagement knob 201 has been designated with a unique alpha character "A" through "E". As can be seen, knobs 201 referenced as A, B, C, and E are shown positioned in a reserve member 204, a fixed element of the fixed resistance selection assembly 200. However, one knob 201, labeled as D, is shown as having been transferred from the reserve member 204 to a reserve slot 219 on the selection device 202, after which, movement of the sliding carriage 106 will concurrently move the engaged knob 201 an equal distance in the same direction as the sliding carriage 106. As shown, knobs 201 referenced as A, B, C, and E are shown in the disengaged position, and the knob 201 referenced as D is shown in the engaged position.

It should be noted that once the carriage 106 begins to move, a resistance assembly support structure 205 affixed to the underside of the carriage 106, and the attached selection device 202 moves concurrently, thereby creating an increased tension upon the backside of the knob 201 referenced as D. Accidental or incidental removal of the knob 201 referenced as D from the selection device 202 would instantly release considerable energy, causing the knob 201 and tension device 112 to violently retract back to the reserve member 204; possibly causing injury to an exerciser during the uncontrolled retraction.

Therefore, a securing member 203 such as a safety latch may be provided to ensure that the engaged knob 201 D remains engaged within the selection device 202 whenever the sliding carriage 106 is moved from its initial resting position. The securing member 203 may be slidable upon one or more slide pins 208 affixed to the selection device 202 in a direction transverse to the longitudinal axis of the monorail center beam 103.

One or more selector biasing members 214 can be seen on the far end of the securing member 203, the ends of the selector biasing members 214 being connected between the securing member 203 and selection device 202. On the near side, a latch magnet 207 is shown as affixed to the securing member 203.

Further, a stationary magnet 206 can be seen affixed to the reserve member 204 structure. Those skilled in the art will appreciate immediately that when the two magnets 206, 207 are in proximity to one another, they will become magnetically attracted and attempt to join together. On the other hand, the two magnets 206, 207, when separated a prescribed distance, may experience magnetic repulsion. Exemplary functional interaction of the magnets 206, 207, securing member 203 and selector biasing members 214 will be further detailed below.

Figure 7B:
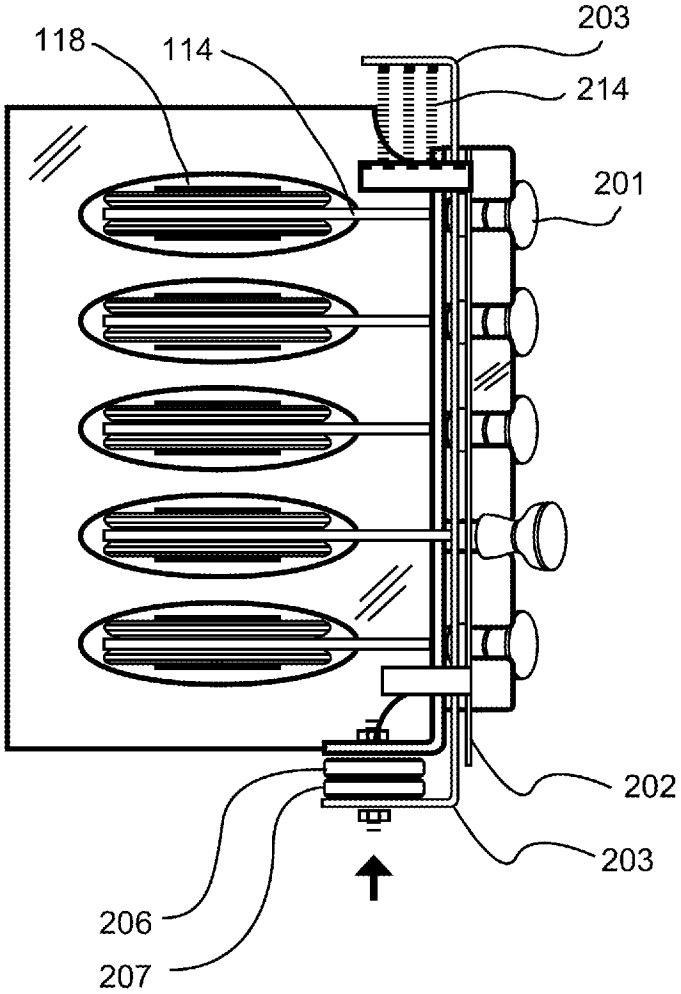
FIG. 7B is an exemplary diagram showing a top view of a disengaged securing member of an exercise machine tension device securing system in accordance with an example embodiment.
Figure 7A:
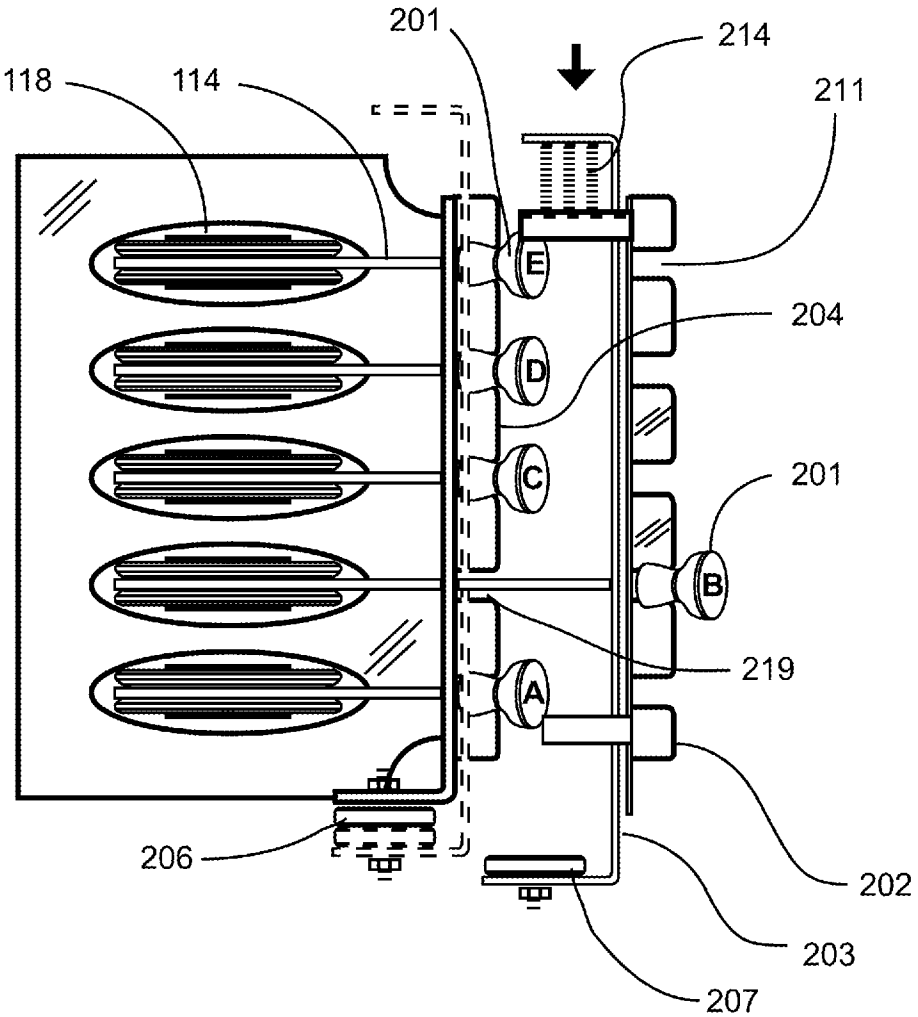
FIG. 7A is an exemplary diagram showing a top view of an engaged securing member of an exercise machine tension device securing system in accordance with an example embodiment.

FIG. 7A is an exemplary diagram showing a top view of an exemplary embodiment of an engaged securing member 203. In the drawing, a plurality of engagement knobs 201 terminate one end of fixed length cables 114 that are threaded around a portion of a plurality of idler pulleys 118. As can be seen, the selection device 202 is shown separated from the resting yoke 204 as evidenced by the fixed length cable terminated at knob 201 B as being extended between the selection device and reserve member 202, 204.

In the position shown, a plurality of selector biasing members 214 force the securing member 203 to slide relative to the selection device 202 in a direction indicated by the arrow. When the securing member 203 is positioned as just described, the knob 201 B is unable to be disengaged from the selection device 202, thus increasing the safety of the exerciser.

FIG. 7B is an exemplary diagram showing a top view of an exemplary embodiment of a disengaged securing member 203. As shown in FIG. 7B, as a result of moving the slidable carriage 106 to a starting position, the selection device 202 is shown proximate to the reserve member 204 in contrast to the position previously described in FIG. 7A.

As the selection device 202 approaches the position proximate to the reserve member 204, a magnetic attraction is created between a stationary magnet 206 and a latch magnet 207. The magnetic attraction force between the two magnets 206, 207 is sufficiently greater than the force created by the selector biasing members 214; thereby causing the securing member 203 to slide relative to the selection device 202 in the direction indicated by the arrow.

When the securing member 203 is positioned as just described, the knob B and tension device 112 is now able to disengage from the selection device 202, thereby allowing an exerciser to re-engage any one or more of the engagement knobs 201, and correspondingly, removably attach the desired number of tension devices 112 to the sliding carriage 106 for a subsequent exercise.

Figure 8A:
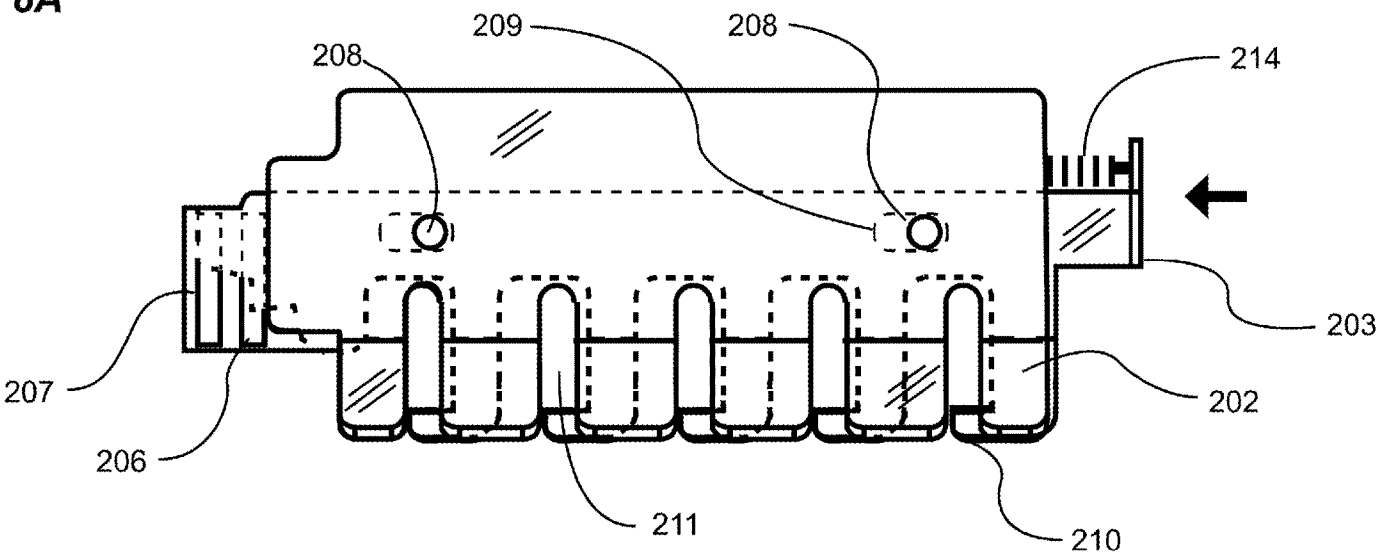
FIG. 8A is an exemplary diagram showing a front view of an engaged securing member of an exercise machine tension device securing system in accordance with an example embodiment.

FIG. 8A is an exemplary diagram showing a front view of an exemplary embodiment of an engaged securing member 203. In the drawing, the selection device 202 is shown positioned in front of the securing member 203. A portion of the securing member 203 can be seen partially exposed on the left and right side of the selection device 202. Portions of the securing member 203, namely a plurality of projections 210 such as latch pawls can also be seen between the slots 211 of the selection device 202, the instant position of the projections 210 thus creating a plurality of closed gates 212 that function as retaining slots 211 for fixed length cables 114 connected to engagement knobs 201 positioned against the selection device 202.

In the position shown, a plurality of selector biasing members 214 such as latch springs may force the securing member 203 to slide left, relative to the selection device 202 in a direction indicated by the arrow. The position is further confirmed as indicated by the position of the slide pins 208 affixed to the selection device 202 relative to the pin slot 209 of the securing member 203 indicated by a hidden line. When the securing member 203 is positioned as just described, the distance between the stationary magnet 206 and the latch magnet 207 is maximized and thus unable to exceed the force of the one or more selector biasing members 214.

Figure 8B:
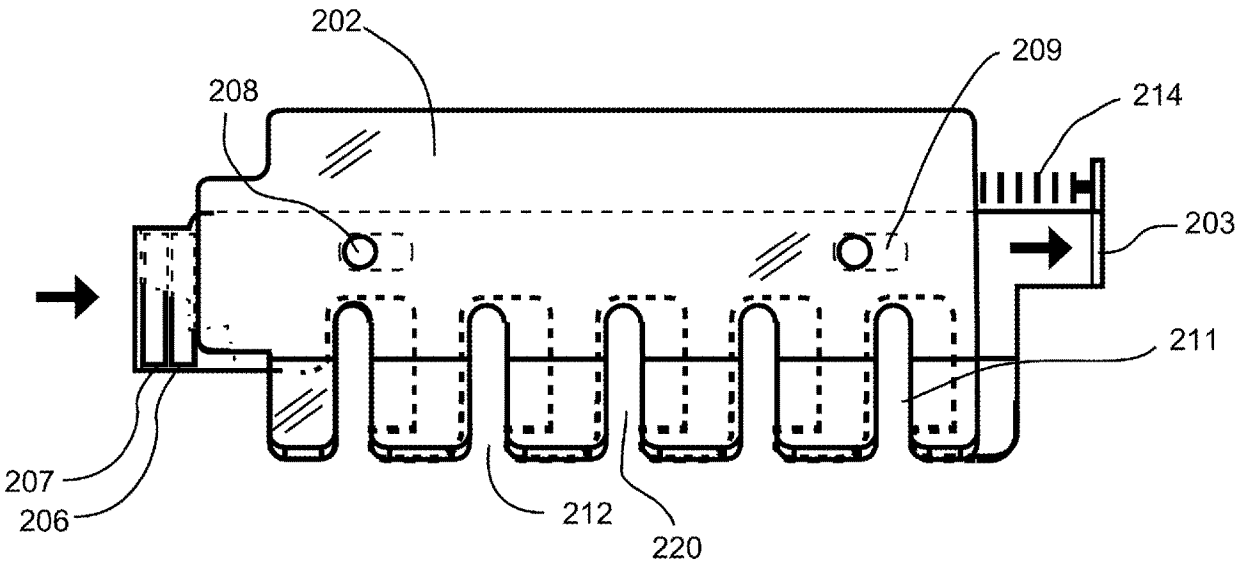
FIG. 8B is an exemplary diagram showing a front view of a disengaged securing member of an exercise machine tension device securing system in accordance with an example embodiment.

FIG. 8B is an exemplary diagram showing a front view of an exemplary embodiment of a disengaged spring securing member 203. As a means of allowing the fixed length cables 114 to be disengaged from the selection device 202, the securing member 203 and projections 210 must be retracted to create open slots 211. As previously discussed, as the selection device 202 is moved proximate to the reserve member 204, magnetic attraction between the stationary magnet 206 and latch magnet 207 increases such that the stationary magnet 206 draws the latch magnet 207 to itself, thus forcing the securing member 203 to slide to the right, opening the gates 212.

Figure 9B:
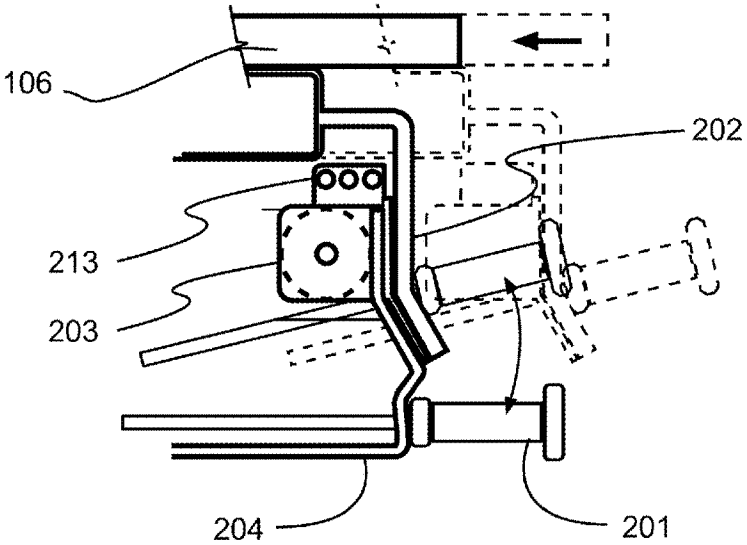
FIG. 9B is an exemplary diagram showing a right side view of a disengaged securing member of an exercise machine tension device securing system in accordance with an example embodiment.
Figure 9A:
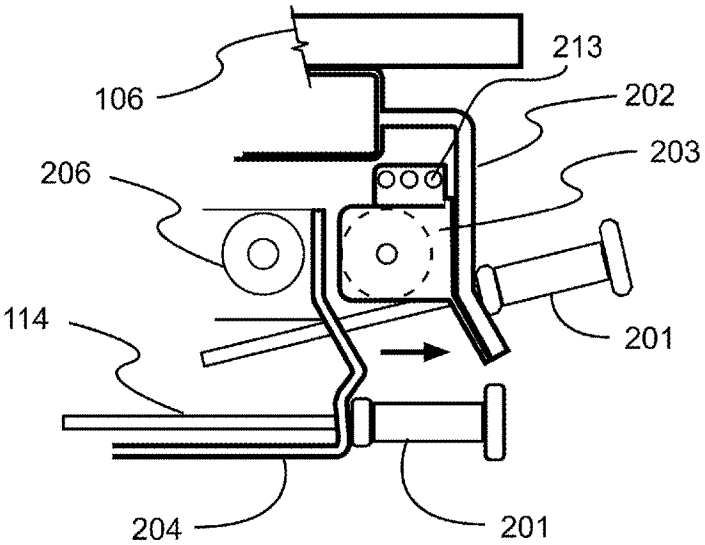
FIG. 9A is an exemplary diagram showing a right side view of a securing member of an exercise machine tension device securing system in accordance with an example embodiment.

FIG. 9A is an exemplary diagram showing a right side view of an exemplary embodiment of a securing member 203. As previously described, a selection device 202 is affixed to a slidable carriage 106. As shown in FIG. 9A, the slidable carriage 106 is shown having been moved relative to the stationary reserve member 204 in the direction of the arrow, thereby engaging the securing member 203.

More specifically, a plurality of engagement knobs 201 are shown at the terminus of respective fixed length cables 114, although a tension device 112 may be attached directly to the engagement knobs 201 without an intermediary fixed length cable 114. One engagement knob 201 is shown angled upwardly, retained in the selection device 202 by a securing member 203 movably (such as slidably) affixed to the selection device 202.

A lower resistance engagement knob 201 is shown in a substantially horizontal position, positioned on and retained by a reserve member 204, the reserve member 204 remaining stationary having been affixed to the machine frame 101. A stationary magnet 206 is shown affixed to the stationary reserve member 204.

FIG. 9B is an exemplary diagram showing a right side view of an exemplary embodiment of a disengaged securing member 203. A selection device 202 is affixed to a slidable carriage 106. In the drawing, the slidable carriage 106 is shown having been moved proximate to the stationary reserve member 204 in the direction of the arrow, from a distal position illustrated by the dashed outline of the carriage 106 and selection device 202, thereby disengaging the securing member 203 by magnetic attraction between the stationary magnet 206 and latch magnet 207 as previously described.

In the position shown in FIG. 9B, the securing member 203 having been disengaged allows an exerciser to reposition the engagement knobs 201 between a lower disengaged position in the reserve member 204 and a raised engaged position in the selection device 202. With the slidable carriage 106 in the position shown, the force exerted by the tension devices 112 is minimized; thereby allowing engagement knob 201 repositioning between the selection device 202 and securing member 204 as described with maximized safety.

Figure 10:
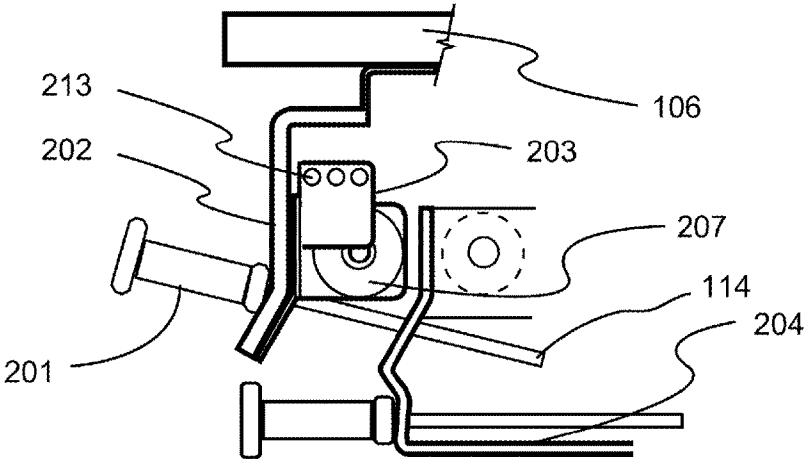
FIG. 10 is an exemplary diagram showing a left side view of an engaged securing member of an exercise machine tension device securing system in accordance with an example embodiment.

FIG. 10 is an exemplary diagram showing a left side view of an exemplary embodiment of an engaged securing member 203. A knob engagement gate 202 is affixed to a slidable carriage 106, and a securing member 203 is slidably affixed to the selection device 202. A plurality of selector biasing members 214 may be retained in the plurality of spring mounting holes 213 as a means of engaging the securing member 203 when the sliding carriage 106 is moved to a position that separates the stationary magnet 206 shown with a dashed circle and the latch magnet 207; the securing member 203 thereby retaining an engagement knob 201 within the closed gate slot of the selection device 202.

Figure 11:
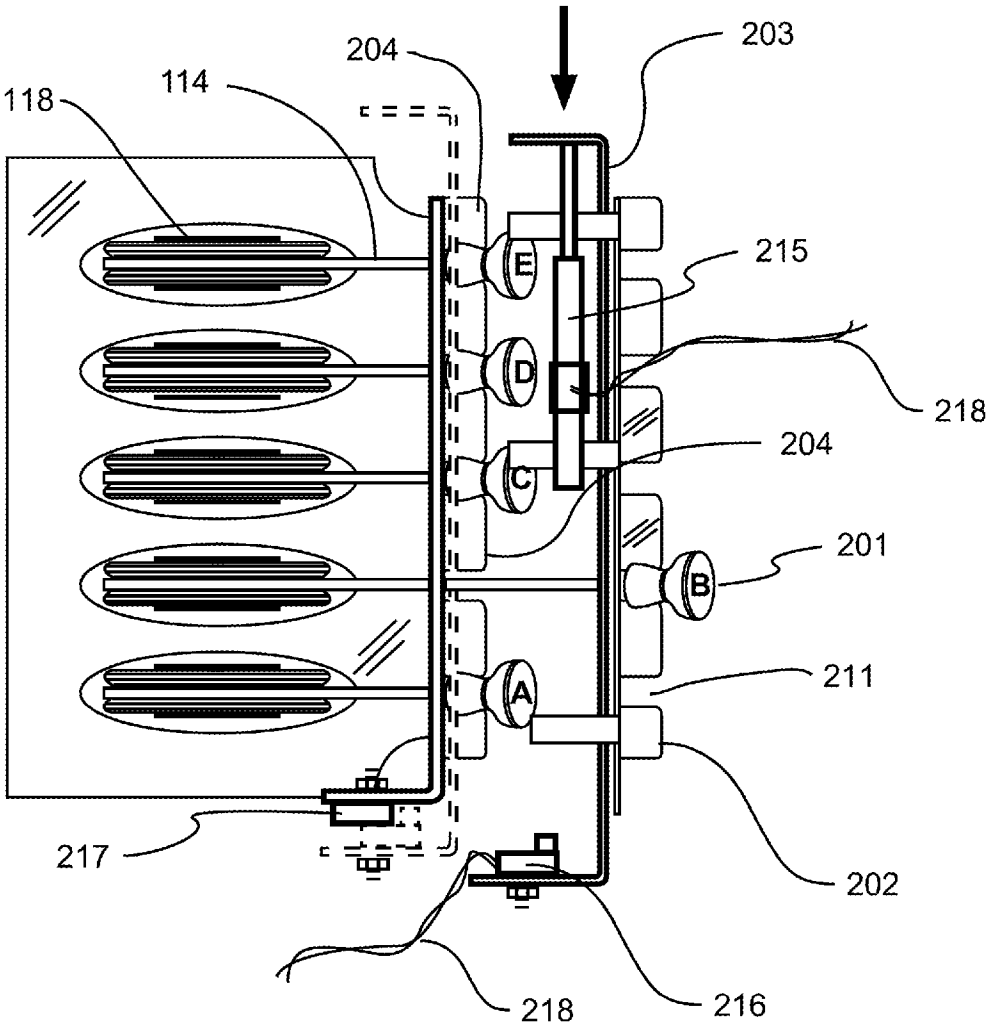
FIG. 11 is an exemplary diagram showing a top view of a linear actuator activated securing member of an exercise machine tension device securing system in accordance with an example embodiment.

FIG. 11 is an exemplary diagram showing a top view of an exemplary embodiment of an actuator-activated securing member 203. As shown in FIG. 11, a plurality of engagement knobs 201 terminate one end of fixed length cables 114 which are themselves connected to the tension devices 112. As can be seen, the selection device 202 is shown separated from the reserve member 204 as evidenced by the fixed length cable 114 terminated at knob 201 B as being extended between the selection device 202 and securing member 204.

As shown in FIG. 11, a proximity switch 216 with signal wires 218 may be connected to a controller 300. In practice, the proximity switch 216 may send a signal to the controller 300 when it is moved proximate or near to a proximity target 217. The signal may be terminated when the proximity switch 216 is moved away from the proximity target 217.

A linear actuator 215 with signal wires 218 connectable to a controller 300 may be affixed to the structure of the selection device 202, the distal end of the movable member of the actuator affixed to a securing member 203, the actuator 215 thereby sliding the securing member 203 closed by moving in the direction of the arrow when the signal from the proximity switch 216 is open.

Although not shown, those skilled in the art will appreciate that when the proximity switch 216 is proximate to the proximity target 217, the signal from the proximity switch 216 would close, causing the linear actuator 215 to retract in length, thereby moving the securing member 203 in a direction opposed to the arrow shown.

Figure 12:
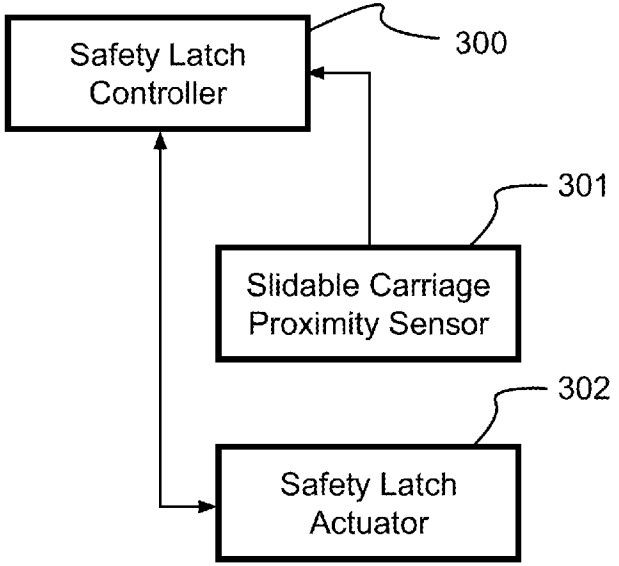
FIG. 12 is an exemplary illustration showing a block diagram of a securing member circuit of an exercise machine tension device securing system in accordance with an example embodiment.

FIG. 12 is an exemplary illustration showing a block diagram of an exemplary embodiment of a securing member 203 circuit. As previously described, a controller 300 may be electrically connected to a proximity sensor 301 and an actuator 302. Upon receiving a closed signal from a proximity switch 216 component of the proximity sensor 301, the actuator 215 will cause the movable member to move in one direction, and upon receiving an open signal from a proximity switch 216 component of the proximity sensor 301, the actuator 215 will cause the movable member to move in the opposed direction, the movable member of the actuator 215 thereby opening or closing the securing member 203.

Figure 13:
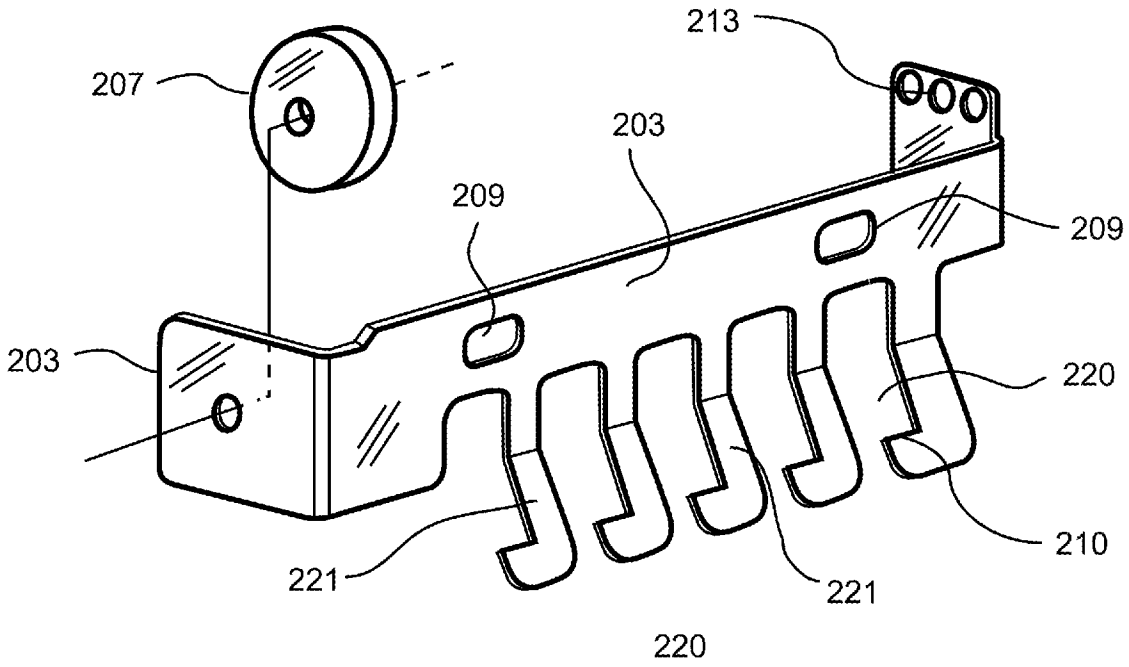
FIG. 13 is an exemplary diagram showing an isometric view of a securing member of an exercise machine tension device securing system in accordance with an example embodiment.

FIG. 13 is an exemplary diagram showing an isometric view of an exemplary embodiment of a securing member 203. As a means of illustrating the physical structure of the securing member 203 which, in the previous diagrams remained largely obscured, FIG. 13 shows a securing member 203 that is slidably affixed to the back side of the selection device 202 as previously described by one or more slide pins 208 inserted through the pin slots 209.

A latch magnet 207 may be securely fastened to the securing member 203 in such a position that it faces the stationary magnet 206 as described above. A plurality of spring mounting holes 213 provide for attachment points for a hooked end of the selector biasing members 214 previously described, but the attachment of selector biasing members 214 to the securing member 203 is not limited to inserting hooked spring ends through mounting holes 213. Those skilled in the art will recognize that a large body of work describes various methods of attaching extension springs to a movable member, and any known and reliable method may be used.

As shown in FIG. 13, the securing member 203 may comprise a plurality of fingers 221 which extend outwardly to define one or more slots 220. While the exemplary embodiment of the figures illustrate that the fingers 221 extend downwardly, it should be appreciated that in some embodiments the fingers 221 may extend in other directions, such as upwardly. As best shown in FIGS. 8A and 8B, the fingers 221 do not impede into the slots 211 of the selection device 202 regardless of whether the securing member 203 is in its first or second positions. As shown in the figures, the slots 211 of the selection device 202 may thus be narrower than the slots 220 of the securing member 203 such that no portion of any finger 221 extends into any slot 211 of the selection device 202 regardless of whether the securing member 203 is engaged or disengaged.

As best shown in FIG. 13, each finger 221 may include a projection 210. Projections 210 are shown on the distal end of each of the fingers 221 of the securing member 203; the projections 210 serving as openers and closers of the slots 211 of the selection device 202. As shown, the projections 210 may be oriented horizontally so as to selectively cover the outer end of the slots 211 of the selection device 202 and thus prevent any tension device 112 from becoming accidentally dislodged during exercise. In other embodiments, the projections 210 may have other orientations so long as the projections 210 are oriented so as to selectively enclose the slots 211 of the selection device 202 to secure the tension devices 112 therein.

In use as best shown in FIGS. 8A and 8B, the securing member 203 may be adjusted between an engaged position in which the projections 210 extend across the slots 211 of the selection device 202 to secure one or more tension devices 112 therein and a disengaged position in which the projections 210 are positioned behind the selection device 202 so as not to extend across any of the slots 211; allowing tension devices 112 to be freely transferred between the selection device 202 and the reserve member 204 or vice versa.

As discussed previously, any number of methods may be utilized for moving the securing member 203 between its engaged and disengaged positions. The securing member 203 may be adapted to automatically disengage when the carriage 106 is in its resting position. When the carriage 106 is moved from its resting position, the securing member 203 may be adapted to automatically engage.

In the exemplary embodiment of FIG. 6, selector biasing members 214 and magnets 206, 207 are utilized to allow for automatic engagement/disengagement of the securing member 203. In the exemplary embodiment of FIG. 11, an actuator 215 is utilized for the same purpose. The actuator 215 may be manually operated, such as by a mobile device (smart phone, remote control, or the like). As shown in FIG. 12, the actuator 215 may also be automatically operated, such as by use of a proximity switch 216 and proximity target 217. In some embodiments, the securing member 203 may be manually engaged or disengaged, such as by hand.

The manner in which the securing member 203 is moved between a first position enclosing the slots 211 and a second position not enclosing the slots 211 may vary in different embodiments. The exemplary embodiment shown in the figures illustrates a side-to-side sliding movement of the securing member 203. It should be appreciated that various other types of motion may be utilized to adjust the securing member 203 between its positions, such as but not limited to flipping the securing member 203 up-and-down, rotating the securing member 203 such as on a hinge (similar to a door), and retracting the securing member 203 fully from the selection device 202.

When the securing member 203 is engaged, such as by sliding the securing member 203 in a first direction with respect to the selection device 202, the projections 210 will move into a position to close off the slots 211 of the selection device 202 and thus secure any tension devices 112 to the carriage 106 without risk of becoming dislodged and causing injury or damage. When the securing member 203 is disengaged, such as by sliding the securing member 203 in a second, opposite direction with respect to the selection device 202, the projections 210 will move into a position to open up the slots 211 of the selection device 202 and thus allow tension devices 112 to be transferred in and out of connection with the carriage 106.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine tension device securing system, suitable methods and materials are described above. All publications, patent applications, patents, and other references mentioned herein are incorporated by reference in their entirety to the extent allowed by applicable law and regulations. The exercise machine tension device securing system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a first end and a second end;

a carriage movably positioned upon the frame;

a first tension device;

a selection device connected to the carriage, wherein the selection device includes a first slot, wherein the first slot is adapted to removably receive the first tension device;

a securing member movably positioned with respect to the selection device; and wherein the securing member is adjustable between a first position where the securing member closes the first slot securing the first tension device within the first slot and a second position where the securing member opens the first slot allowing the first tension device to be removed from the first slot.

2. The exercise machine of claim 1, wherein the securing member comprises a first projection for selectively securing the first tension device within the first slot.

3. The exercise machine of claim 2, wherein the first slot is vertically oriented and the first projection is horizontally oriented.

4. The exercise machine of claim 3, wherein the securing member comprises a first finger extending downwardly, wherein the first projection extends from the first finger.

5. The exercise machine of claim 4, wherein the first finger and the first projection form a J-shaped structure.

6. The exercise machine of claim 1, wherein the securing member is adapted to slide horizontally with respect to the selection device.

7. The exercise machine of claim 1, further comprising a selector biasing member connected to the securing member, wherein the selector biasing member is adapted to apply a biasing force to the securing member biasing the securing member toward the first position.

8. The exercise machine of claim 7, further comprising wherein the selector biasing member is connected between the selection device and the securing member.

9. The exercise machine of claim 7, wherein the selector biasing member is comprised of a spring.

10. The exercise machine of claim 7, further comprising a first magnet and a second magnet, wherein the first magnet is connected to the securing member, wherein a magnetic attraction force is created between the first magnet and the second magnet when the first magnet is near the second magnet, wherein the magnetic attraction force is greater than the biasing force of the selector biasing member thereby causing the securing member to slide relative to the selection device to the second position.

11. The exercise machine of claim 1, further comprising an actuator connected to the securing member, wherein the actuator is adapted to move the securing member between the first position and the second position.

12. The exercise machine of claim 11, further comprising a carriage proximity sensor, wherein the carriage proximity sensor is configured to send a signal to the actuator, wherein the actuator moves the securing member to the first position or the second position based on the signal from the carriage proximity sensor.

13. The exercise machine of claim 1, wherein the first tension device is comprised of a spring.

14. The exercise machine of claim 1, further comprising a second tension device, wherein the selection device includes a second slot, wherein the second slot is adapted to removably receive the second tension device, and wherein the securing member closes the second slot securing the second tension device within the second slot when in the first position and wherein the securing member opens the second slot allowing the second tension device to be removed from the second slot.

15. The exercise machine of claim 14, wherein the securing member comprises a second projection for selectively securing the second tension device within the second slot.

16. The exercise machine of claim 15, wherein the second slot is vertically oriented and the second projection is horizontally oriented.

17. The exercise machine of claim 16, wherein the securing member comprises a second finger extending downwardly, wherein the second projection extends from the second finger.

18. The exercise machine of claim 17, wherein the second finger and the second projection form a J-shaped structure.

19. An exercise machine, comprising:

a frame having a first end and a second end;

a carriage movably positioned upon the frame;

a first tension device and a second tension device;

a selection device connected to the carriage, wherein the selection device includes a first slot that is vertically orientated and a second slot that is vertically orientated, wherein the first slot is adapted to removably receive the first tension device, and wherein the second slot is adapted to removably receive the second tension device;

a first projection movably positioned with respect to the selection device for selectively securing the first tension device within the first slot, wherein the first projection is horizontally orientated;

a second projection movably positioned with respect to the selection device for selectively securing the second tension device within the second slot, wherein the second projection is horizontally orientated; and wherein the first projection and the second projection are each adjustable between a first position and a second position, wherein the first projection closes the first slot to secure the first tension device within the first slot when the first projection is in the first position, wherein the first slot is open allowing the first tension device to be removed from the first slot when the first projection is in the second position, wherein the second projection closes the second slot to secure the second tension device within the second slot when the second projection is in the first position, and wherein the second slot is open allowing the second tension device to be removed from the second slot when the second projection is in the second position.

20. An exercise machine, comprising:

a frame having a first end and a second end;

a carriage movably positioned upon the frame;

a first tension device and a second tension device;

a selection device connected to the carriage, wherein the selection device includes a first slot that is vertically orientated and a second slot that is vertically orientated, wherein the first slot is adapted to removably receive the first tension device, and wherein the second slot is adapted to removably receive the second tension device;

a securing member movably positioned with respect to the selection device, wherein the securing member includes a first finger extending downwardly and a second finger extending downwardly;

a first projection extending horizontally from the first finger for selectively securing the first tension device within the first slot;

a second projection extending horizontally from the second finger for selectively securing the second tension device within the second slot; and wherein the securing member is adjustable between a first position and a second position, wherein the first projection closes the first slot to secure the first tension device within the first slot when the securing member is in the first position, wherein the first slot is open allowing the first tension device to be removed from the first slot when the securing member is in the second position, wherein the second projection closes the second slot to secure the second tension device within the second slot when the securing member is in the first position, and wherein the second slot is open allowing the second tension device to be removed from the second slot when the securing member is in the second position.

* * * * *